US008764135B1

(12) United States Patent
Huang

(10) Patent No.: US 8,764,135 B1
(45) Date of Patent: Jul. 1, 2014

(54) LINKING MECHANISM

(71) Applicant: Nan Juen International Co., Ltd., New Taipei (TW)

(72) Inventor: Kuo-Sheng Huang, New Taipei (TW)

(73) Assignee: Nan Juen International Co., Ltd., New Taipei (TW)

( * ) Notice: Subject to any disclaimer, the term of this patent is extended or adjusted under 35 U.S.C. 154(b) by 0 days.

(21) Appl. No.: 13/845,088

(22) Filed: Mar. 18, 2013

(51) Int. Cl.
*A47B 95/00* (2006.01)

(52) U.S. Cl.
USPC ..... 312/333; 312/331

(58) Field of Classification Search
CPC ..... A47B 88/047; A47B 88/0477; A47B 88/0481; A47B 2210/0064; A47B 2210/0072
USPC ..... 312/331, 333, 334.2, 334.3
See application file for complete search history.

(56) References Cited

U.S. PATENT DOCUMENTS 363,647 A * 5/1887 Knaus ..... 312/331
399,752 A * 3/1889 Horrocks ..... 312/331
905,544 A * 12/1908 Lampert ..... 312/319.1
2,267,043 A * 12/1941 Premo ..... 384/18
2,667,400 A * 1/1954 Wotring ..... 312/331
3,545,833 A * 12/1970 Coe et al. ..... 312/334.9
3,687,505 A * 8/1972 Fall et al. ..... 384/18
3,722,964 A * 3/1973 Chitester et al. ..... 384/18
5,240,318 A * 8/1993 Schroder et al. ..... 312/319.1
5,564,807 A * 10/1996 Rock et al. ..... 312/331
7,331,643 B2 * 2/2008 Huber et al. ..... 312/319.5
7,901,017 B1 * 3/2011 Kafferlin ..... 312/221
2003/0117048 A1 * 6/2003 Mueller ..... 312/330.1
2004/0227439 A1 * 11/2004 Salice ..... 312/333
2005/0001523 A1 * 1/2005 Wiklund et al. ..... 312/330.1
2006/0214547 A1 * 9/2006 Bonner et al. ..... 312/319.5
2006/0261717 A1 * 11/2006 Chirumbolo ..... 312/333
2007/0103043 A1 * 5/2007 Kropf et al. ..... 312/334.5
2008/0036345 A1 * 2/2008 Kropf et al. ..... 312/333
2008/0211366 A1 * 9/2008 Brock et al. ..... 312/333
2010/0295433 A1 * 11/2010 Randall ..... 312/333
2011/0037362 A1 * 2/2011 Park et al. ..... 312/319.1

* cited by examiner

*Primary Examiner* — Hanh V Tran

(57) ABSTRACT

A linking mechanism includes a rotary wheel set, a linking cord set and an actuator set s chair includes a chair body carrying a rotating wheel and coupled between a drawer cabinet and a drawer to synchronize the operation of two sliding rail assemblies that are coupled between the drawer and the drawer cabinet, enabling the drawer to be accurately moved in and out of the drawer cabinet between an open position and a close position.

7 Claims, 8 Drawing Sheets

LINKING MECHANISM

BACKGROUND OF THE INVENTION

1. Field of the Invention

The present invention relates to drawer and drawer cabinet mounting technology and more particularly, to a linking mechanism capable of synchronizing the operation of the two sliding rail assemblies that are coupled between a drawer and a drawer cabinet.

2. Description of the Related Art

Sliding rail assemblies are in drawer cabinets to secure drawers, enabling drawers to be moved in and out of drawer cabinets between a close position and an open position. However, if the applied force is not applied to the middle part of the front side of the drawer, the drawer may be biased. Further, Taiwan Patent M365677, equivalent to U.S. Pat. No. 8,079,653, discloses a sliding track assembly for controlling positioning of a movable object in a fixed object, for example, a drawer in a drawer cabinet, between a close position and an open position. This design of sliding track assembly is repeatedly pressable to control positioning of a positioning block in a circulating guide groove. However, if the user presses a part of the front side of the movable object (drawer) far from the midpoint between the two sliding track assemblies, only one sliding track assembly will be opened or locked. In this case, the drawer will not be opened or fully opened. Further, during application of auto-close sliding track assemblies, the drawer may be not fully closed due to large drawer clearance or uneven pulling force of spring members.

SUMMARY OF THE INVENTION

The present invention has been accomplished under the circumstances in view. It is the main object of the present invention to provide a linking mechanism, which is capable of synchronizing the operation of two sliding rail assemblies that are coupled between a drawer and a drawer cabinet, enabling the drawer to be accurately moved in and out of the drawer cabinet between an open position and a close position.

To achieve this and other objects of the present invention, a linking mechanism comprises a rotary wheel set mounted at two opposite inner lateral sidewalls of a drawer cabinet, an actuator set mounted at two opposite outer lateral sidewalls of a drawer for rotating two rotary tables of the rotary wheel set, and a linking cord set coupled between two rotary tables of the rotary wheel set.

DETAILED DESCRIPTION OF THE PREFERRED EMBODIMENT

Figure 1:
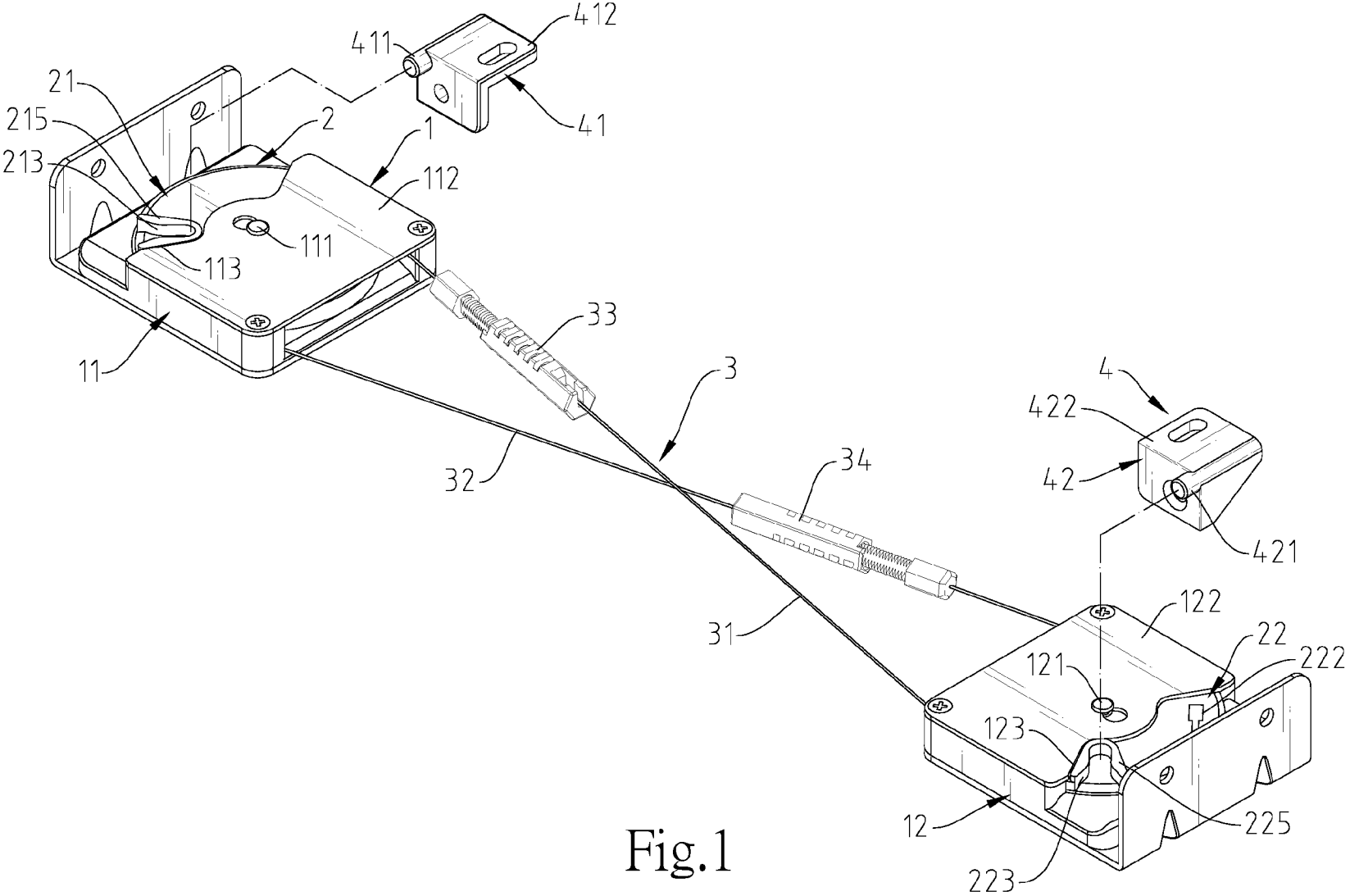
FIG. 1 is a top elevational view of a linking mechanism in accordance with the present invention.
Figure 2:
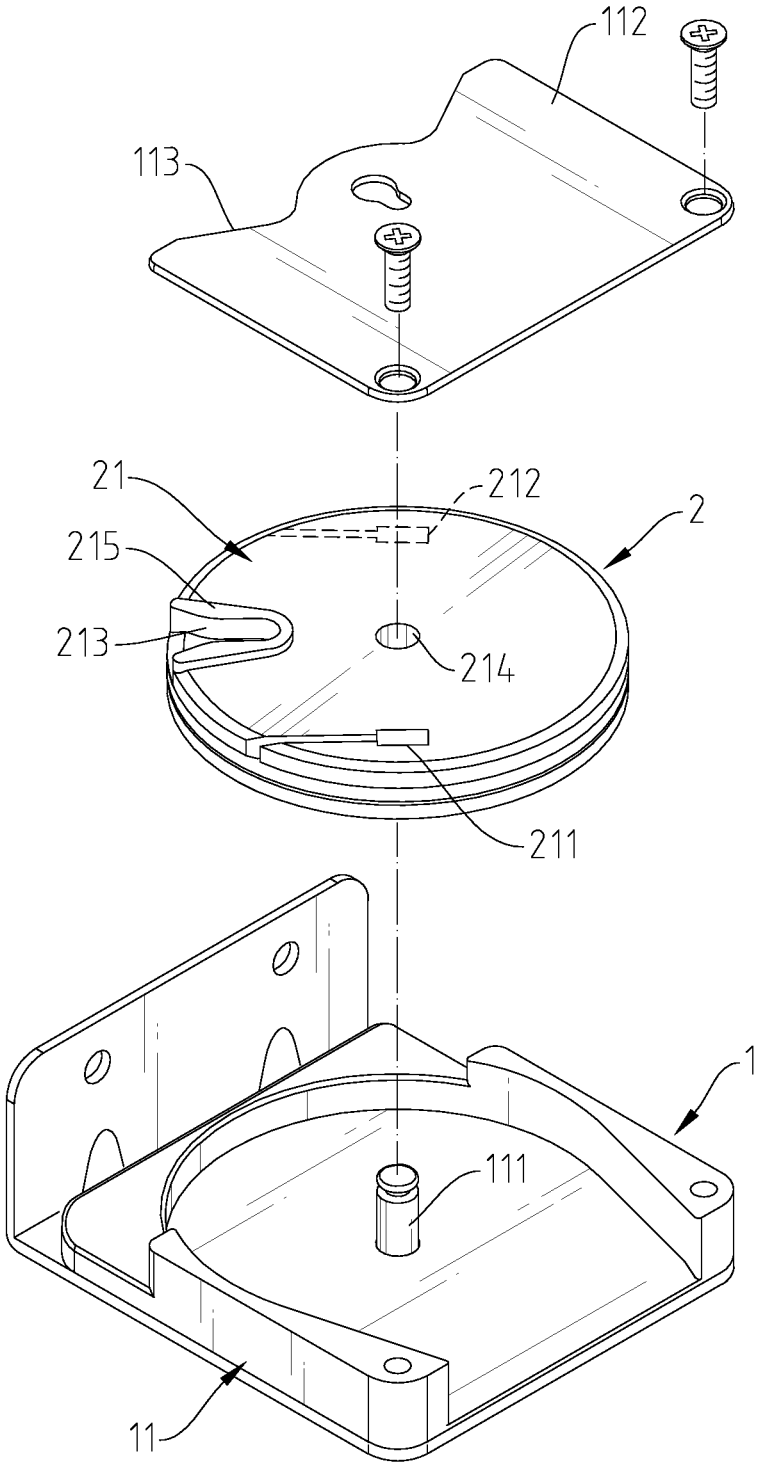
FIG. 2 is an exploded view of a part of the linking mechanism in accordance with the present invention (I).
Figure 3:
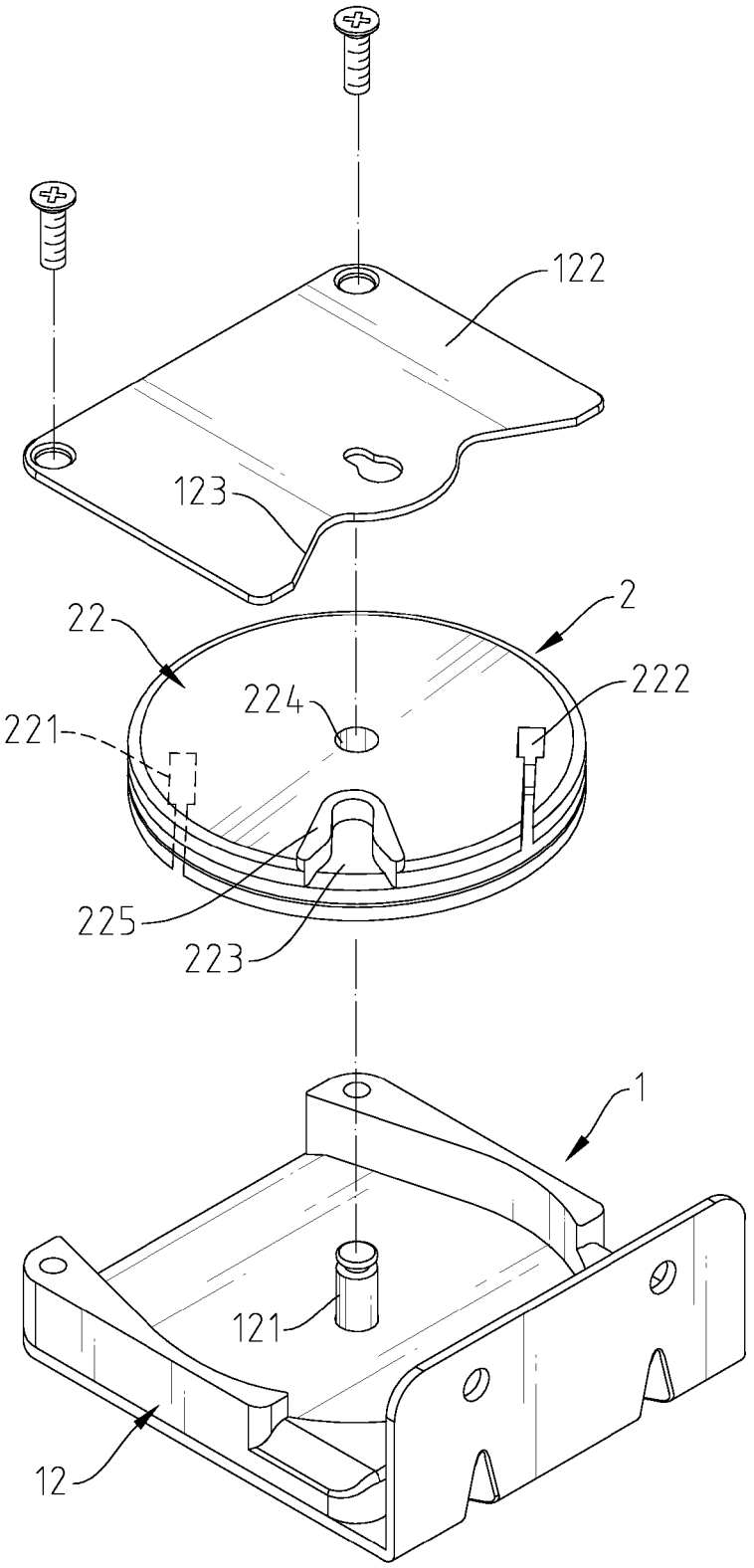
FIG. 3 is an exploded view of a part of the linking mechanism in accordance with the present invention (II).
Figure 4:
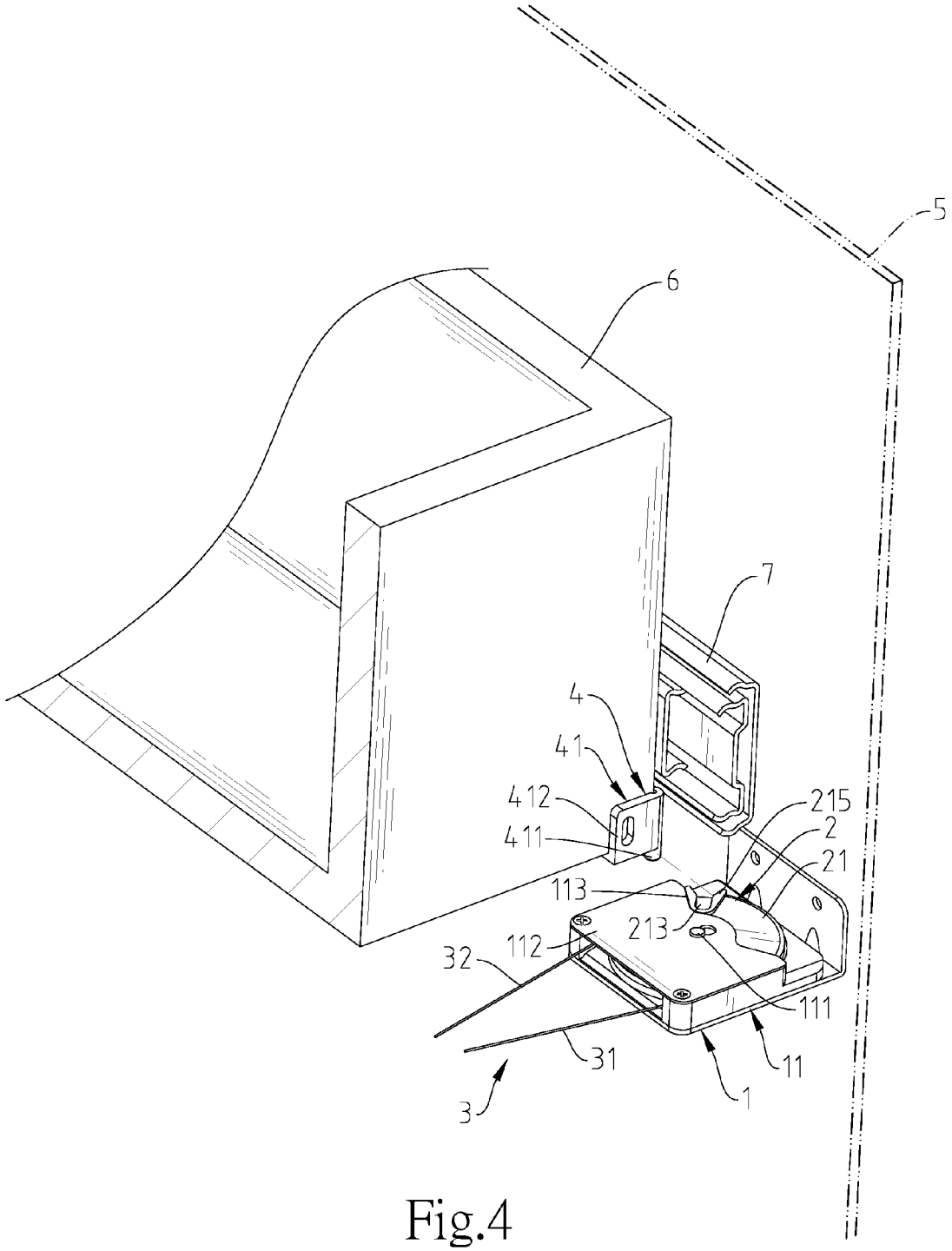
FIG. 4 is a schematic installed view of the linking mechanism in accordance with the present invention (I).
Figure 5:
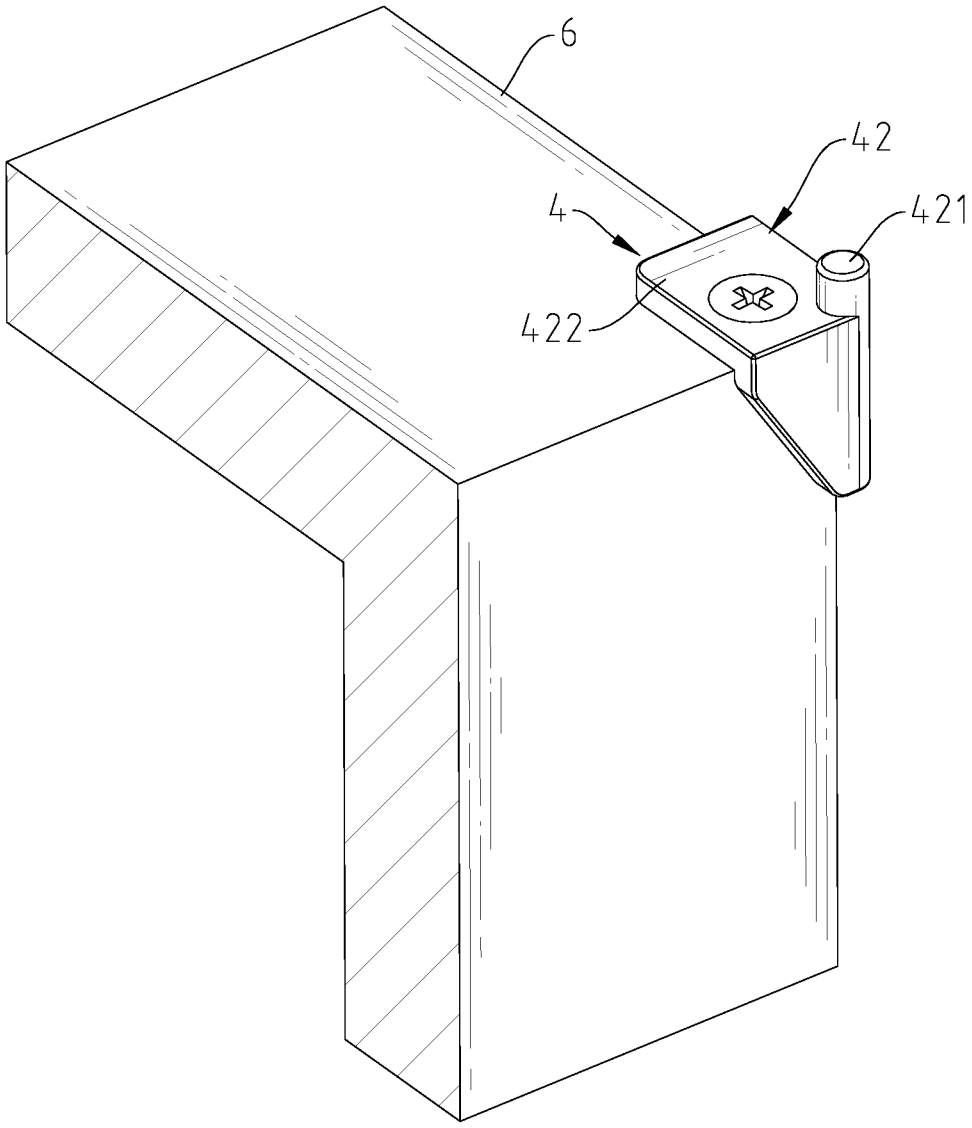
FIG. 5 is a schematic installed view of the linking mechanism in accordance with the present invention (II).
Figure 6:
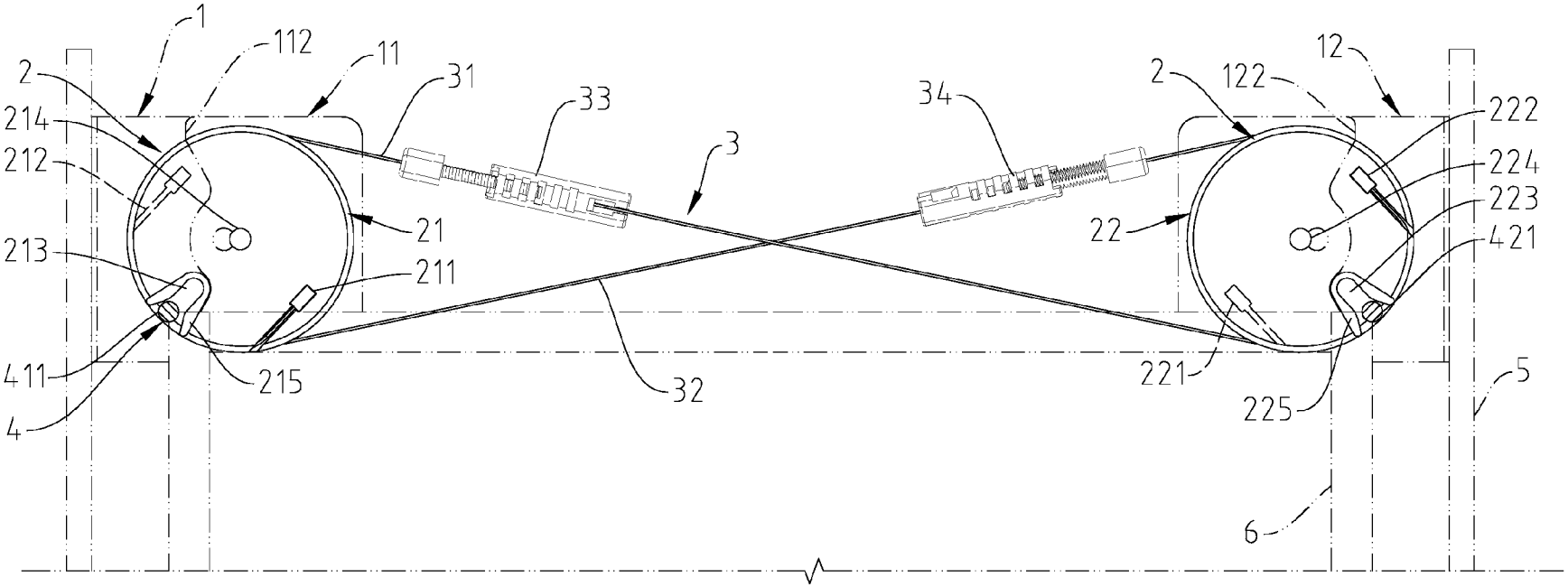
FIG. 6 is a schematic drawing illustrating an operating status of the linking mechanism in accordance with the present invention (I).

Referring to FIGS. 1-6, two sliding rail assemblies 7 are respectively arranged between two opposite outer lateral sidewalls of a drawer 6 and two opposite inner lateral sidewalls of a drawer cabinet 5, and a linking mechanism in accordance with the present invention is shown coupled between the drawer 6 and the drawer cabinet 5. Subject to the functioning of the sliding rail assemblies 7, the drawer 6 can be moved in and out of the drawer cabinet 5 between an open position and a close position.

The linking mechanism comprises a wheel holder set 1, a rotary wheel set 2, a linking cord set 3, and an actuator set 4. The wheel holder set 1 comprises a first wheel holder 11, which comprises a first pivot axle 111 and a first top cover 112 located at the top side thereof beyond the first pivot axle 111 and defining a first curved track 113, and a second wheel holder 12, which comprises a second pivot axle 121 and a second top cover 122 located at the top side thereof beyond the second pivot axle 121 and defining a second curved track 123. The rotary wheel set 2 comprises a first rotary table 21 and a second rotary table 22. The first rotary table 21 comprises a first locating portion 211 and a first connection portion 212 respectively located at opposing top and bottom sides thereof, a first driven slot 213 located at the periphery thereof between the first locating portion 211 and the first connection portion 212, a first center pivot hole 214, and a first rib 215 extend around one side of the first driven slot 213. The second rotary table 22 comprises a second locating portion 221 and a second connection portion 222 respectively located at opposing top and bottom sides thereof, a second driven slot 223 located at the periphery thereof between the second locating portion 221 and the second connection portion 222, a second center pivot hole 224, and a second rib 225 extending around one side of the second driven slot 223. The linking cord set 3 comprises a first linking cord 31, a second linking cord 32, a first tension adjustment device 33 adapted for adjustment of the tension of the first linking cord 31, and a second tension adjustment device 34 adapted for adjustment of the tension of the second linking cord 32. The actuator set 4 comprises a first actuator 41 and a second actuator 42. The first actuator 41 comprises a first driving rod 411, and a first locating plate 412. The second actuator 42 comprises a second driving rod 421 and a second locating plate 422.

The first wheel holder 11 and second wheel holder 12 of the wheel holder set 1 are respectively affixed to the two opposite inner lateral sidewalls of the drawer cabinet 5. The first center pivot hole 214 of the first rotary table 21 is coupled to the first pivot axle 111 of the first wheel holder 11. The second center pivot hole 224 of the second rotary table 22 is coupled to the second pivot axle 121 of the second wheel holder 12. The linking cord set 3 is installed in the rotary wheel set 2 in such a manner that the first linking cord 31 has its one end connected to the first locating portion 211 of the first rotary table 21 and its other end extended to the second rotary table 22 and wound round the first connection portion 212 of the first rotary table 21 and the second connection portion 222 of the second rotary table 22 and then connected to the second locating portion 221. The second linking cord 32 has its one end connected to the first connection portion 212 of the first rotary table 21, and its other end extended toward the second rotary table 22 and then wound round the first locating portion 211 of the first rotary table 21 and the second locating portion 221 of the second rotary table 22 and then connected to the second connection portion 222 so that the first linking cord 31 and the second linking cord 32 extend across each other and coupled between the first rotary table 21 and the second rotary table 22. The first locating plate 412 of the first actuator 41 and the second locating plate 422 and the second actuator 42 are respectively fastened to the two opposite outer lateral sidewalls of the drawer 6, keeping the first driving rod 411 of the first actuator 41 in the first driven slot 213 of the first rotary table 21 and the second driving rod 421 of the second actuator 42 in the second driven slot 223 of the second rotary table 22.

Figure 7:
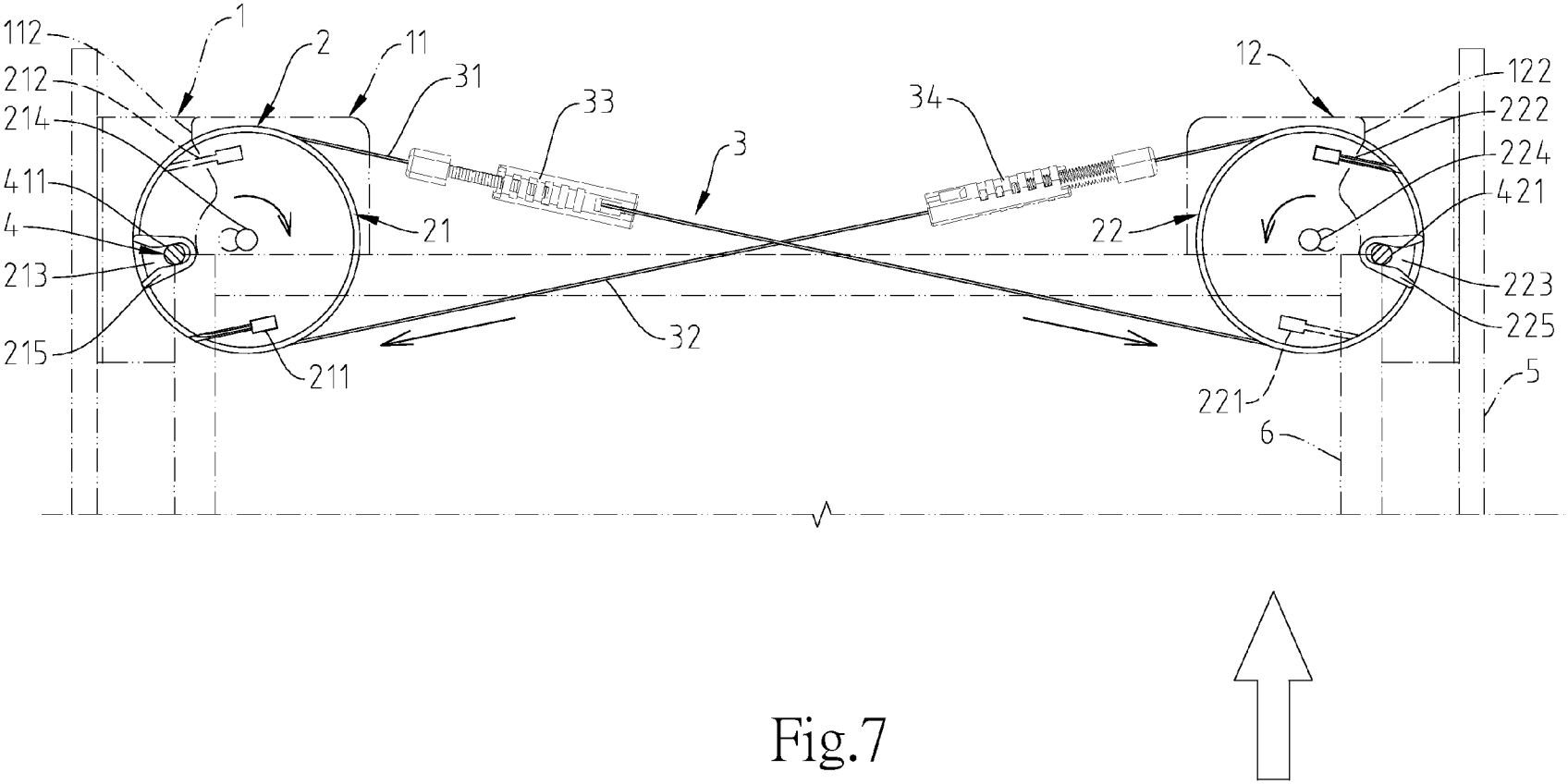
FIG. 7 is a schematic drawing illustrating an operating status of the linking mechanism in accordance with the present invention (II).
Figure 8:
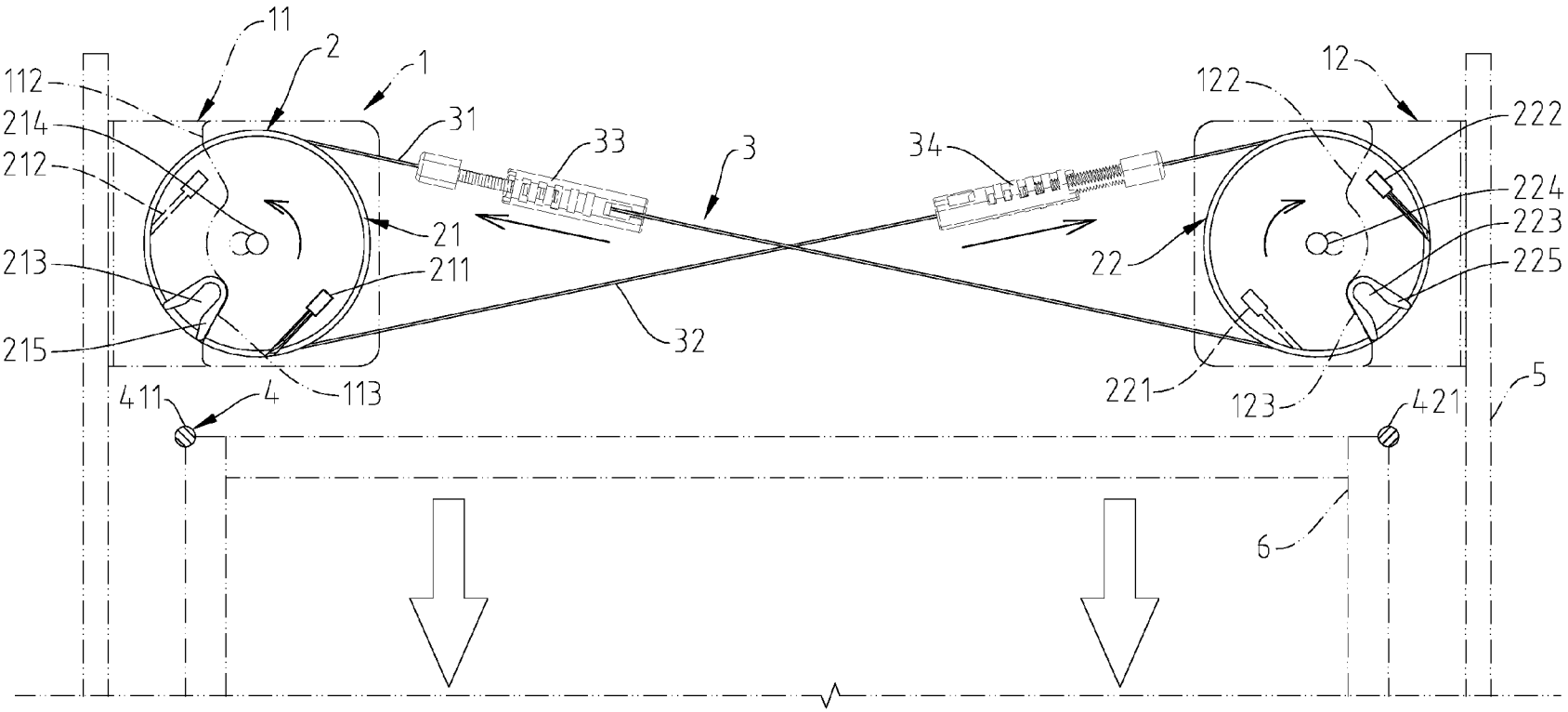
FIG. 8 is a schematic drawing illustrating an operating status of the linking mechanism in accordance with the present invention (III).

Referring to FIGS. 7 and 8 and FIGS. 4-6 again, when the drawer 6 is received in the drawer cabinet 5, the first driving rod 411 of the first actuator 41 and the second driving rod 421 of the second actuator 42 are respective inserted into the first driven slot 213 of the first rotary table 21 and the second driven slot 223 of the second rotary table 22. If the user presses a part of the front side of the drawer 6 far from the midpoint thereof, for example, the right corner area that is close to the second driving rod 421 (see the hollow arrowhead sign in FIG. 7), the second driving rod 421 will be forced by the drawer 6 to push the second driven slot 223 of the second rotary table 22 and to further rotate the second rotary table 22. During rotation of the second rotary table 22, the second linking rod 32 will be driven to rotate the first rotary table 21 in direction reversed to the second rotary table 22 to further move the first driving rod 411 of the first actuator 41, forcing the first actuator 41 to move the drawer 6. Thus, the operation of the two sliding rail assemblies 7 are synchronized, enabling the drawer 6 to be fully closed. On the contrary, when the user presses the left corner area of the front side of the drawer 6 that is close to the first driving rod 411, the first driving rod 411 will be forced by the drawer 6 to push the first driven slot 213 of the first rotary table 21 and to further rotate the first rotary table 21. During rotation of the first rotary table 21, the first linking rod 31 will be driven to rotate the second rotary table 22 in direction reversed to the first rotary table 21 to further move the second driving rod 421 of the second actuator 42, forcing the second actuator 42 to move the drawer 6. Thus, the two sliding rail assemblies 7 are synchronously unlocked, opening the drawer 6. Further, because the first rib 215 of the first rotary table 21 is attached to the first curved track 113 of the first top cover 112 and the second rib 225 of the second rotary table 22 is movably attached to the second curved track 123 of the second top cover 122, the angle of rotation of the first rotary table 21 and second rotary table 22 are limited to a predetermined range.

What the invention claimed is:

1. A linking mechanism coupled between a drawer and a drawer cabinet, comprising:

a rotary wheel set comprising a first rotary table and second rotary table respectively pivotally coupled to two opposite inner lateral sidewalls of said drawer cabinet, said first rotary table comprising a first center pivot hole, a first locating portion and a first connection portion respectively disposed at opposing top and bottom sides thereof and a first driven slot first located at the periphery thereof between said locating portion and said first connection portion, said second rotary table comprising a second center pivot hole, a second locating portion and a second connection portion located at opposing top and bottom sides thereof and a second driven slot located at the periphery thereof between said second locating portion and said second connection portion, said first locating portion and said second locating portion;

a linking cord set comprising a first linking cord and a second linking cord, said first linking cord having one end thereof connected to said first locating portion of said first rotary table and an opposite end thereof extending toward said second rotary table and connected to said second locating portion of said second rotary table, said second linking cord having one end thereof connected to said first connection portion of said first rotary table and an opposite end extending across said first linking cord and connected to said second connection portion of said second rotary table; and an actuator set comprising a first actuator and a second actuator respectively fastened to two opposite outer lateral sidewalls of said drawer, said first actuator comprising a first driving rod inserted into said first driven slot of said first rotary table, said second actuator comprising a second driving rod inserted into said second driven slot of said second rotary table.

2. The linking mechanism as claimed in claim 1, wherein further comprising a wheel holder set, said wheel holder set comprising a first wheel holder and a second wheel holder respectively affixed to the two opposite inner lateral sidewalls of said drawer cabinet, said first wheel holder comprising a first pivot axle pivotally coupled to said first center pivot hole of said first rotary table, said second wheel holder comprising a second pivot axle pivotally coupled to said second center pivot hole of said second rotary table.

3. The linking mechanism as claimed in claim 1, further comprising a wheel holder set, said wheel holder set comprising a first wheel holder and a second wheel holder respectively affixed to the two opposite inner lateral sidewalls of said drawer cabinet to support said first rotary table and said second rotary table, a first top cover and a second top cover respectively covered on said first wheel holder and said second wheel holder outside said first rotary table and said second rotary table, said first top cover defining a first curved track, said second top cover defining a second curved track, wherein said first rotary table comprises a first rib extending around one side of said first driven along and movable along said first curved track between two ends of said first curved track upon rotation of said first rotary table relative to said first wheel holder; said second rotary table comprises a second rib extending around one side of said second driven along and movable along said second curved track between two ends of said second curved track upon rotation of said second rotary table relative to said second wheel holder.

4. The linking mechanism as claimed in claim 1, wherein said first locating portion is located at the top side of said first rotary table; said first connection portion is located at the bottom side of said first rotary table; said second locating portion is located at the bottom side of said second rotary table; said second connection portion is located at the top side of said second rotary table.

5. The linking mechanism as claimed in claim 1, wherein said linking cord set further comprises a first tension adjustment device installed in said first linking cord and adjustable to adjust the tension of said first linking cord, and a second tension adjustment device installed in said second linking cord and adjustable to adjust the tension of said second linking cord.

6. The linking mechanism as claimed in claim 1, wherein said first actuator of said actuator set comprises a first locating plate affixed to one outer lateral sidewall of said drawer; said second actuator of said actuator set comprises a second locating plate affixed to the other outer lateral sidewall of said drawer; said first driving rod of said first actuator extends from said first locating plate; said second driving rod extends from said second locating plate.

7. The linking mechanism as claimed in claim 1, wherein said first linking cord has one end thereof connected to said first locating portion of said first rotary table and the other end thereof wound round said first connection portion of said first rotary table and said second connection portion of said second rotary table and then connected to said second locating portion; said second linking cord has one end thereof connected to said first connection portion of said first rotary table and the other end thereof wound round said first locating portion of said first rotary table and said second locating portion of said second rotary table and then connected to said second connection portion.

* * * * *